US012601264B2

(12) United States Patent
Holger

(10) Patent No.: US 12,601,264 B2
(45) Date of Patent: Apr. 14, 2026

(54) RADIAL EXPANDER

(71) Applicant: MAN Energy Solutions SE, Augsburg (DE)

(72) Inventor: Franz Holger, Oberhausen (DE)

(73) Assignee: EVERLLENCE SE, Augsburg (DE)

( * ) Notice: Subject to any disclaimer, the term of this patent is extended or adjusted under 35 U.S.C. 154(b) by 0 days.

(21) Appl. No.: 18/061,626

(22) Filed: Dec. 5, 2022

(65) Prior Publication Data

US 2023/0175400 A1 Jun. 8, 2023

(30) Foreign Application Priority Data

Dec. 7, 2021 (DE) ..... 10 2021 132 142.5

(51) Int. Cl.
*F01D 5/04* (2006.01)
*F01D 1/08* (2006.01)
*F01D 1/22* (2006.01)

(52) U.S. Cl.
CPC ..... *F01D 5/048* (2013.01); *F01D 1/08* (2013.01); *F01D 1/22* (2013.01)

(58) Field of Classification Search
CPC . F01D 5/043; F01D 5/048; F01D 1/08; F01D 1/22; F04D 17/025
See application file for complete search history.

(56) References Cited

U.S. PATENT DOCUMENTS 4,243,357 A * 1/1981 Flynn ..... F01D 5/043 415/218.1
4,652,212 A * 3/1987 Burger ..... F01D 5/048 416/DIG. 2
5,215,439 A * 6/1993 Jansen ..... F04D 29/284 416/235
5,730,582 A * 3/1998 Heitmann ..... F04D 29/284 416/185

(Continued)

FOREIGN PATENT DOCUMENTS

DE 3441115 C1 1/1986
DE 10 2013 216 609 A1 * 2/2015

(Continued)

OTHER PUBLICATIONS

English machine translation of DE-10 2016 206 678-A1, Nov. 12, 2023.*

(Continued)

*Primary Examiner* — Christopher Verdier
(74) *Attorney, Agent, or Firm* — COZEN O'CONNOR

(57) ABSTRACT

A radial expander having a rotor mounted in a housing and comprising multiple blades. The blades together with a radially inner hub contour of a rotor hub and a radially outer housing contour define flow channels for the process gas, which process gas to be expanded enters in a radial direction and from which expanded process gas exits in the axial direction. The radially inner hub contour of the rotor includes a curvature change at least in some circumferential positions seen in the meridional section such that adjacent to (Continued)

a flow leading side of the rotor, the radially inner hub contour, seen in the meridional section, is curved radially to the outside and adjacent to a flow trailing side of the rotor, the radially inner hub contour, seen in the meridional section, is curved radially to the inside.

13 Claims, 2 Drawing Sheets

(56) References Cited

U.S. PATENT DOCUMENTS

| | | | | |
|---|---|---|---|---|
| 2004/0081548 | A1 | 4/2004 | Zess et al. | |
| 2012/0269635 | A1 | 10/2012 | Xu | |
| 2015/0086395 | A1* | 3/2015 | Dextraze | F04D 17/10 416/192 |
| 2015/0118079 | A1* | 4/2015 | Dextraze | F01D 5/146 417/406 |
| 2015/0118080 | A1* | 4/2015 | Dextraze | F04D 29/284 417/406 |

FOREIGN PATENT DOCUMENTS

| | | |
|---|---|---|
| DE | 10 2016 206 678 A1 * | 10/2017 |
| GB | 944166 | 4/2016 |
| WO | WO 99/61801 | 12/1999 |

OTHER PUBLICATIONS

English machine translation of DE-10 2013 216 609-A1, Nov. 12, 2023.*

Search Report dated Jun. 10, 2024 issued in French Patent Application No. 2212854.

* cited by examiner

RADIAL EXPANDER

BACKGROUND OF INVENTION

1. Field of the Invention

The disclosure relates to an expander, namely a radial expander.

2. Description of Related Art

Basically, expanders and compressors are distinguished in turbo machines. Expanders are also referred to as turbines and serve for expanding a process gas to extract energy during the expansion of the process gas. Compressors compress a process gas utilising energy.

Radial expanders known from practice are equipped with a housing and a rotor mounted in the housing, wherein the rotor comprises multiple blades. Together with a radially inner hub contour of the rotor and a radially outer housing contour of the housing, the blades of the rotor define flow channels for the process gas. Process gas to be expanded enters these flow channels in the radial direction or substantially in the radial direction. The expanded process gas exits these flow channels in the axial direction or substantially in the axial direction.

SUMMARY OF THE INVENTION

To provide a radial expander with as high as possible an efficiency it is desirable to reduce secondary flows in the flow channels. This ensures a better flow-through the flow channels. When an assembly for the further control of the expanded process gas, for example a diffuser, is arranged downstream of the radial expander, the efficiency of the diffuser can also be increased by way of the reduced secondary flows in the radial expander.

One aspect of the present invention is creating a new type of radial expander with reduced secondary flows.

According to one aspect of the invention, the radially inner hub contour of the rotor comprises a curvature change seen in the meridional section at least in some circumferential positions in such a manner that adjacent to a flow inlet side of the rotor, the radially inner hub contour, seen in the meridional section, is curved radially to the outside and adjacent to a flow outlet side of the rotor, the radially inner hub contour, seen in the meridional section, is curved radially to the inside. A radial expander can be provided in the case of which secondary flows, in particular secondary flows in the height direction and thus radial direction of the flow channels of the rotor can be reduced. In particular the flow through the hub region can be improved. The radial expander has an increased efficiency.

Preferentially, the curvature change is the only curvature change of the radially inner hub contour.

Preferentially, the curvature change, in those circumferential positions in which the radially inner hub contour of the rotor, in the meridional section, comprises the curvature change, the curvature change is in a range between 5% and 45% of the working length of the radially inner hub contour. This contouring of the radially inner hub contour is particularly preferred for the better flow through the hub region of the radial expander in order to ultimately increase the efficiency of the radial expander.

Preferentially, a minimal curvature radius of the portion of the hub contour curved radially to the inside in those circumferential positions, in which the radially inner hub contour of the rotor, seen in the meridional section, comprises the curvature change, is situated between 5% and 30%, preferably between 10% and 15% of the working length of the radially inner hub contour after the curvature change. This feature also serves for improving the flow through the hub region of the radial expander for increasing the efficiency.

Preferentially, a ratio between the curvature radius of the portion of the hub contour curved radially to the outside and the hub-side radius of a flow inlet edge of the blades, in those circumferential positions, in which the radially inner hub contour of the rotor, seen in the meridional section, comprises the curvature change, is greater than 1. By way of this, the flow in particular through the hub region can be further improved while avoiding secondary flows.

Preferentially, a ratio between the minimal curvature radius of the portion of the hub contour curved radially to the inside and the hub-side radius of a flow inlet edge of the blades, in those circumferential positions in which the radially inner hub contour of the rotor, seen in the meridional section, comprises the curvature change, is smaller than 2. By way of this, the flow through the hub region while avoiding secondary flows can also be further improved.

According to one aspect, the radially inner hub contour of the rotor, seen in the meridional section, is contoured differently in the circumferential direction. In particular when the hub contour of the rotor, seen in the circumferential direction, is contoured differently, the same is embodied circumference-asymmetrically. Here, a peak curved radially to the outside into the flow channel and a valley curved radially to the inside are then preferentially formed between each two blades adjacent in the circumferential direction, wherein by way of this in particular the formation of horseshoe vortices and channel vortices, each of which represent secondary flow phenomena, can be effectively counteracted. With the circumference-asymmetrical contouring of the hub contour, the flow through the flow channels, in particular in the hub region, can still be further improved and the efficiency of the radial expander increased even further.

According to one aspect, the radially inner hub contour of the rotor, seen in the meridional section, is contoured identically in all circumferential positions. In particular when, seen in the circumferential direction, the inner hub contour is contoured identically in all circumferential positions, the hub contour is embodied circumference-symmetrically.

BRIEF DESCRIPTION OF THE DRAWINGS

Preferred further developments of the invention are obtained from the subclaims and the following description. Exemplary embodiments of the invention are explained in more detail by way of the drawing without being restricted to this. There it shows:

DETAILED DESCRIPTION OF THE PRESENTLY PREFERRED EMBODIMENTS

A radial expander, which can also be referred to as radial turbine, serves for expanding process gas in order to extract energy during the expansion of the process gas.

A radial expander is equipped with a housing and with a rotor rotatably mounted in the housing.

Figure 1:
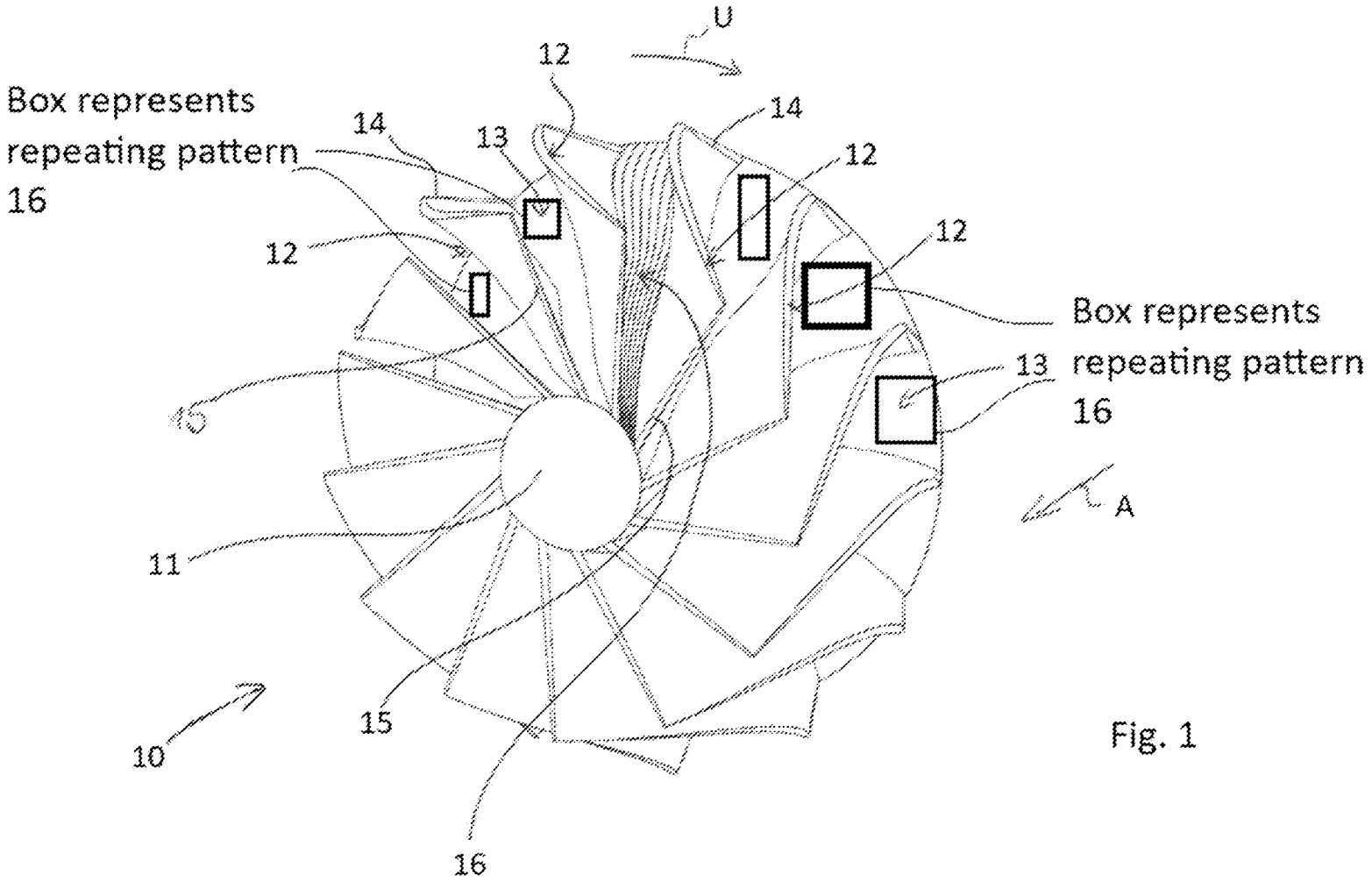
FIG. 1: is a perspective view of a radial expander.

FIG. 1 shows a rotor 10 of a radial expander, wherein the rotor 10 comprises a hub body 11 and multiple blades 12 spaced apart from one another in the circumferential direction U and connected to the hub body 11. Between each two blades 12, adjacent in the circumferential direction U, a flow channel 13 for the process gas is formed.

The blades 12 have flow leading edges 14 and flow trailing edges 15. In the region of the flow leading edges 14, the process gas to be expanded enters a respective flow channel 13 in the radial direction R or substantially in the radial direction R. The expanded process gas exits the respective flow channel 13 in the axial direction or substantially in the axial direction A.

Figure 2:
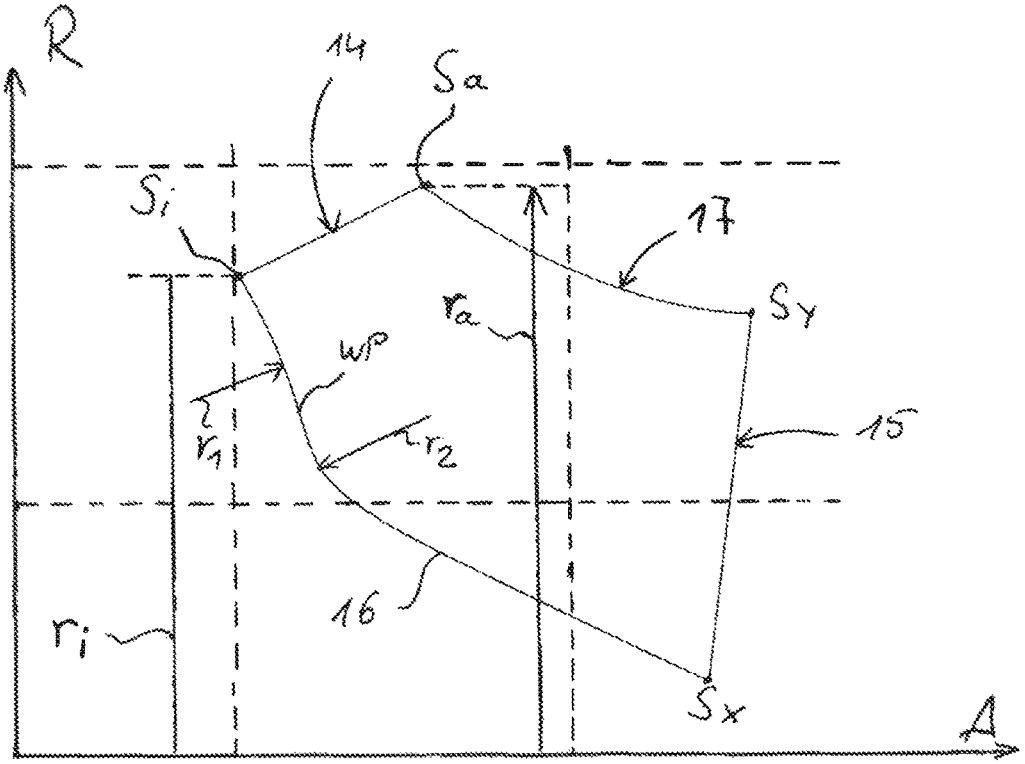
FIG. 2: is a meridional section through the radial expander.

FIG. 2 shows a meridional section through the rotor 10, wherein one aspect of the invention relates to the contouring of the radially inner hub contour 16 of the rotor 10 seen in the meridional section.

Furthermore, a radially outer housing contour 17 of the radial expander and the orientation of a flow leading edge 14 and of a flow trailing edge 15 of a blade 12 is shown in FIG. 2.

According to FIG. 2, the flow leading edge 14 is set obliquely relative to the axial direction A and the radial direction R in such a manner that an intersection point Si of the flow leading edge 14 with the hub contour 16 is situated on a radius ri that is smaller than the radius ra, on which an intersection point Sa of the flow leading edge 14 with the housing contour 17 is situated. The radius ri corresponds to the hub-side radius of the flow leading edge 14.

In FIG. 2 it is shown, further, that an intersection point Sx of the flow trailing edge 15 with the radially inner hub contour 16, has a shorter distance in the axial direction A from the intersection points Si and Sa than the intersection point Sy of the flow trailing edge 15 with the radially outer housing contour 17. In other embodiments, the intersection point Sx of the flow trailing edge 15 with the inner hub contour 16 can also have the same or a greater distance in the axial direction A from the intersection points Si and Sa than the intersection point Sy of the flow trailing edge 15 with the radially outer housing contour 17.

Such a radial expander is also referred to as a diagonal expander.

According to one aspect of the invention, the radially inner hub contour 16 of the rotor 10 is contoured in some circumferential positions seen in the meridional section in such a manner that the hub contour 16 in these circumferential positions, seen in the meridional section, comprises a curvature change in such a manner that adjacent to the flow leading side of the rotor 10 or flow leading edge 14 of the blades 12 the radially inner hub contour 16, seen in the meridional section, is curved radially to the outside and, adjacent to the flow trailing side of the rotor 10 or flow trailing edge 15 of the blades 12, seen in the meridional section, is curved radially to the inside. As shown, circumferentially between a suction side and a pressure side of each pair of the plurality of blades and between the portion of the hub contour curved radially to the outside and the hub contour curved radially to the inside, a reversal portion changes from a convex contour to a concave contour at an axial position.

The radially inner hub contour 16 comprises the curvature change seen in the running direction of the same between the intersection points Si and Sx, wherein the curvature change in the reversal point WP is positioned between the portion of the hub contour 16 curved radially to the outside and the portion of the contour curved radially to the inside.

The curving of the hub contour 16 radially to the outside adjacent to the flow leading side of the rotor 10 is visualised in FIG. 2 by the radius r1. The curving of the hub contour 16 radially to the inside adjacent to the flow trailing side is visualised in FIG. 2 by the radius r2.

It is pointed out that seen in the working length or running direction of the hub contour 16, the radius r1, emanating from the intersection point Si changes, just as the radius r2 seen from the reversal point WP in the direction of the intersection point Sx changes.

In each position of the working length of the radially inner hub contour 16 an individual radius r1 or r2 can be present, wherein in the reversal point WP the radially inner hub contour 16 is not curved in order to provide the curvature change.

In such circumferential positions of the rotor 12, in which the hub contour 16, seen in the meridional section, comprises the curvature change, the reversal point WP and thus the curvature change is situated in a range between 5% and 45% of the working length of the radial hub contour 16 between the intersection point Si and the intersection point Sx, wherein the intersection point Si is situated at 0% of the working length and the intersection point Sx at 100% of the working length of the radially inner hub contour 16.

Further it is provided that in those circumferential positions of the rotor 10, in which the radially inner hub contour 16, seen in the meridional section, comprises the curvature radius, a ratio between the curvature radius r1 of the portion of the hub contour 16 curved radially to the outside and the hub-side radius ri of the intersection point of the flow leading edge 14 with the hub contour 16 is greater than 1. Thus: r1/ri>1 applies.

Further it is provided that in those circumferential positions of the rotor 10, in which the radially inner hub contour 16, seen in the meridional section, comprises the curvature change, a ratio between a minimal curvature radius r2 MIN of the portion of the hub contour 16 curved radially to the inside and the hub-side radius ri of the intersection point of the flow leading edge 14 with the hub contour 16 is smaller than 2. Thus: r2 MIN/ri<2 applies.

As already explained, the reversal point WP and thus the curvature change is positioned between 5% and 45% of the working length of the radially inner hub contour 16 between the hub contour 16 curved radially to the outside and the hub contour 16 curved radially to the inside. As likewise already explained, the respective curvature radius r1, r2 of the curvature of the hub contour 16 changes both upstream of the reversal point WP and also downstream of the reversal point WP.

There it is preferentially provided that the minimal curvature radius r2 MIN downstream of the reversal point WP, in which the hub contour 16 is curved radially to the inside, is situated between 5% and 30% of the working length after the reversal point WP.

As already explained, the hub contour 16 comprises the above contouring with the curvature change at least in some circumferential positions seen in the meridional section. According to a variant of the invention, the radially inner hub contour 16 of the rotor 10, seen in the meridional section, is identically contoured in the circumferential direction in all circumferential positions. This then leads to a circumference-symmetrical contouring of the radially inner hub contour 16 in the circumferential direction.

Figure 3:
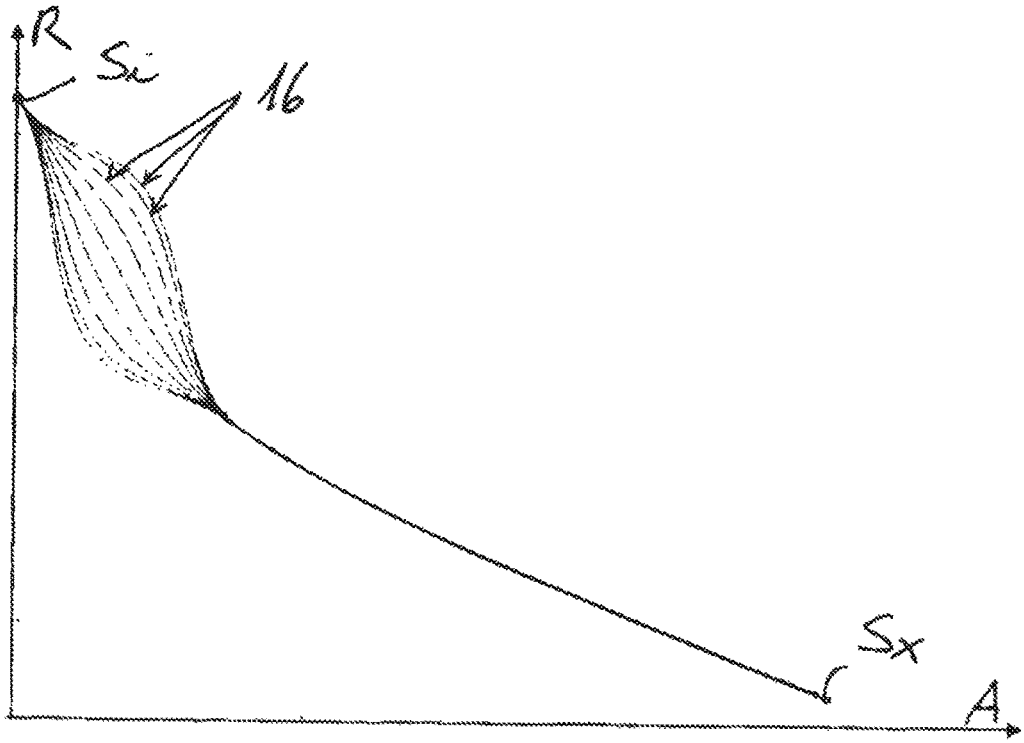
FIG. 3: is multiple meridional sections through the radial expander between two blades adjacent in the circumferential direction with circumference-asymmetrical hub contour.

According to one aspect of the invention, the radially inner hub contour 16 of the rotor 10 seen in the meridional section is contoured differently in the circumferential direction. Preferentially, this takes place in such a manner that between two blades 12 adjacent in the circumferential direction the radially inner hub contour 16, seen in first meridional sections, comprises the curvature change described above and seen in second meridional sections, comprises no curvature change, namely with curvature radii each changing in the circumferential direction, so that between two blades 12 adjacent in the circumferential direction a peak radially curved to the outside and a valley curved to the inside is formed on the radially inner hub contour 16. In the meridional sections without curvature change, the radially inner hub contour 16 is continuously curved radially to the inside, namely with a curvature radius changing in the running direction. FIG. 3 shows multiple radially inner hub contours 16 between two blades 12 of meridional sections spaced apart in the circumferential direction. Portions of the hub contour 16 on the flow leading side curved radially to the outside define the respective peak, portions of the hub contour 16 curved radially to the inside define the respective valley, wherein the valleys and peaks seen in the running direction of the radially inner hub contour 16 are formed adjacent to the flow leading side.

In particular when seen in the circumferential direction the radially inner hub contour 16 changes in the meridional section, it is preferentially provided that between two blades adjacent in the circumferential direction, the ratio r1/ri between the curvature radius r1 of the portion of the hub contour 16 curved radially to the outside and the hub-side radius ri of the flow leading edge 14 of the blade 12 and/or the ratio r2/ri between the curvature radius r2 of the portion of the hub contour 16 curved radially to the inside and the hub-side radius ri of the flow leading edge 14 of the blades 12 changes and/or the position of the curvature change and thus the reversal point WP between the curvatures along the working length of the radially inner hub contour 16 each changes by maximally 15%. In this case it is provided, further, that the radially inner hub contour 16 of the rotor 10 is cyclically repeated in each case between each two blades 12 that are adjacent in the circumferential direction. Accordingly, a peak and a valley are formed adjacent to the flow leading side between each two adjacent blades.

The radial expander according to one aspect of the invention, be it with circumference-symmetrically contoured hub contour or circumference-asymmetrically contoured hub contour, has a high efficiency since in particular secondary flows in the height direction of the flow channels between the blades 12 can be reduced. In particular, there is a better flow through the hub region of the flow channels 13. In particular in the case of a radial expander with circumference-asymmetrically contoured hub contour, secondary flow phenomena such as horseshoe vortices and channel vortices can be reduced.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A radial expander configured to expand a process gas, comprising:

a housing;

a rotor mounted in the housing, the rotor comprising a plurality of blades;

a hub of the rotor; and flow channels for the process gas formed by the plurality of blades of the rotor together with a radially inner hub contour of the hub of the rotor and a radially outer housing contour of the housing, the flow channels configured to expand the process gas that enters in a radial direction or substantially in the radial direction and from which expanded process gas exits in an axial direction or substantially in the axial direction, wherein the radially inner hub contour of the rotor comprises a single curvature change at an axial position seen in a meridional section such that adjacent to a flow leading side of the rotor the radially inner hub contour, seen in the meridional section, is curved radially to the outside and adjacent to a flow trailing side of the rotor, the radially inner hub contour, seen in the meridional section, is curved radially to the inside, and wherein, as seen circumferentially, between a suction side and a pressure side of each pair of the plurality of blades and between the portion of the hub contour curved radially to the outside and the hub contour curved radially to the inside a reversal portion changes from a convex contour to a concave contour.

2. The radial expander according to claim 1, wherein in those circumferential positions, in which the radially inner hub contour of the rotor comprises the single curvature change in the meridional section, the single curvature change is situated in a range between 5% and 45% of a working length of the radially inner hub contour.

3. The radial expander according to claim 1, wherein in those circumferential positions, in which the radially inner hub contour of the rotor, seen in the meridional section, comprises the single curvature change, a ratio between a curvature radius of a portion of the radially inner hub contour curved radially to the outside and a hub-side radius of a flow leading edge of a respective blade is greater than 1.

4. The radial expander according to claim 1, wherein in those circumferential positions, in which the radially inner hub contour of the rotor, seen in the meridional section, comprises the single curvature change, a ratio between a minimal curvature radius of a portion of the radially inner hub contour curved radially to the inside and a hub-side radius of a flow leading edge of a respective blade is smaller than 2.

5. The radial expander according to claim 1, wherein the radially inner hub contour of the rotor, seen in the meridional section, is contoured differently in a circumferential direction.

6. The radial expander according to claim 5, wherein the radially inner hub contour of the rotor, seen in the meridional section, is contoured differently in the circumferential direction such that between two circumferentially adjacent blades, the radially inner hub contour of the rotor, seen in first meridional sections, comprises the single curvature change and, seen in second meridional sections, does not comprise any curvature change, so that between each two circumferentially adjacent blades a peak curved radially to the outside and a valley curved radially to the inside are formed.

7. The radial expander according to claim 5, wherein the radially inner hub contour of the rotor, seen in the meridional section, is contoured differently in the circumferential direction such that between two circumferentially adjacent blades, a ratio between a curvature radius of a portion of the radially inner hub contour curved radially to the outside and a hub-side radius of a flow leading edge of the blades changes.

8. The radial expander according to claim 5, wherein the radially inner hub contour of the rotor, seen in the meridional section, is contoured differently in the circumferential direction in such a manner that between two circumferentially adjacent blades, a ratio between a curvature radius of a portion of the radially inner hub contour curved radially to the inside and a hub-side radius of a flow leading edge of the blades changes.

9. The radial expander according to claim 5, wherein the radially inner hub contour of the rotor, seen in the meridional section, is contoured differently in the circumferential direction in such a manner that a position of the single curvature change changes by maximally 15% along a working length of the radially inner hub contour.

10. The radial expander according to claim 7, wherein the radially inner hub contour of the rotor between each two circumferentially adjacent blades is cyclically repeated.

11. The radial expander according to claim 1, wherein the radially inner hub contour of the rotor, seen in the meridional section, is contoured equally in all circumferential positions.

12. A radial expander configured to expand a process gas, comprising:

a housing;

a rotor mounted in the housing, the rotor comprising a plurality of blades;

a hub of the rotor; and flow channels for the process gas formed by the plurality of blades of the rotor together with a radially inner hub contour of the hub of the rotor and a radially outer housing contour of the housing, the flow channels configured to expand the process gas that enters in a radial direction or substantially in the radial direction and from which expanded process gas exits in an axial direction or substantially in the axial direction, wherein the radially inner hub contour of the rotor comprises a single curvature change seen in a meridional section such that adjacent to a flow leading side of the rotor the radially inner hub contour, seen in the meridional section, is curved radially to the outside and adjacent to a flow trailing side of the rotor, the radially inner hub contour, seen in the meridional section, is curved radially to the inside, wherein in those circumferential positions, in which the radially inner hub contour of the rotor, seen in the meridional section, comprises the single curvature change, a minimal curvature radius of a portion of the radially inner hub contour curved radially to the inside is situated between 5% and 30%, of a working length of the radially inner hub contour after the single curvature change.

13. The radial expander according to claim 12, wherein the minimal curvature radius of a portion of the radially inner hub contour curved radially to the inside is situated between 10% and 15% of the working length of the radially inner hub contour after the single curvature change.

* * * * *